United States Patent [19]

Reinhall

[11] 4,121,967

[45] Oct. 24, 1978

[54] SCREW CONVEYOR IN PULP-MAKING EQUIPMENT

[76] Inventor: Per Gustaf Reinhall, 834 171st Pl. NE., Bellevue, Wash. 98008

[21] Appl. No.: 752,749

[22] Filed: Dec. 21, 1976

[30] Foreign Application Priority Data

Sep. 7, 1976 [SE] Sweden ..... 7609879

[51] Int. Cl.[2] ..... B30B 9/12; D21C 7/06

[52] U.S. Cl. ..... 162/246; 100/148; 100/150; 100/117

[58] Field of Search ..... 100/150, 117, 148; 162/236, 237, 246, 18

[56] References Cited

U.S. PATENT DOCUMENTS

| | | | |
|---|---|---|---|
| 785,876 | 3/1905 | Gropp | 100/150 |
| 1,076,995 | 10/1913 | Renneburg | 100/150 |
| 1,553,976 | 9/1925 | Bernot et al. | 162/236 X |
| 1,968,180 | 7/1934 | Ten Bosch | 100/150 |
| 2,893,909 | 7/1959 | Schouvlin et al. | 162/236 X |
| 3,092,338 | 6/1963 | Reinhall | 100/117 X |

FOREIGN PATENT DOCUMENTS

| | | | |
|---|---|---|---|
| 1,063,522 | 12/1953 | France | 100/150 |
| 1,070,844 | 2/1954 | France | 100/150 |

*Primary Examiner*—Richard V. Fisher
*Attorney, Agent, or Firm*—Eric Y. Munson

[57] ABSTRACT

A screw conveyor which is particularly used for feeding in and compressing ligno-cellulosic material, such as wood chips, shavings, bagasse, sawdust and similar compressable material. The screw conveyor comprises a casing having a bore which tapers conically from a material inlet and to a material outlet end. A screw feeder having helical flights and an intervening spiral groove rotates within the bore to advance the material fed into the casing towards the outlet end while being progressively compressed into a plug. The casing has an opening in which stopper means move in a closed circuit to successively engage the spiral groove during the rotation of the screw feeder, thereby preventing the material from rotating and thus allowing it to be continually advanced while being progressively compressed.

4 Claims, 2 Drawing Figures

II
II
10
12
14
16
18
20
22
24
26
28
30
32
34
36
38
40
42
44
46
48
50
52

SCREW CONVEYOR IN PULP-MAKING EQUIPMENT

BACKGROUND OF THE INVENTION

The invention relates to a screw conveyor or a screw press for conveying compressible or compactable material through a tubular elongated casing from the inlet end to the outlet end thereof. The material collects in the grooves between the flights of the helix and is advanced through the bore of the casing by the rotation of the screw while being compressed progressively during its passage from the inlet end to the outlet end where it acquires the form of a substantially compact plug.

The invention is particularly applicable to a defibrating apparatus of the well-known Asplund Defibrator type, as shown, for example, in U.S. Pat. No. 2,145,851. In such apparatuses, the ligno-cellulosic material, such as wood chips, shavings, sawdust and bagasse, etc., are fed from a hopper or storage bin into a casing which houses a helical screw feeder which transports the material to further pulp processing equipment, which may include mechanical defibrators or other disc refiners, digesters and other pressure vessels, wherein the material is maintain in an atmosphere of pressurized steam. In addition to conveying the pump material from the hopper to the subsequent pulp processing station, the screw feeder also serves to progressively compress or compact the fibroius material during its passage through the bore of the casing, so that it forms a plug at the discharge end thereof, which acts as a seal against blow-back of steam or other medium from the pressurized system.

When employing conventional screw feeders, it has been shown that friction created by the compacting process often causes the material to be rotated along with the helix, and thus interrupts the uniform flow of material through the apparatus, with consequent plugging problems and costly machinery downtime in the system.

These problems have been partly solved by rifling the bore of the casing or the feeder throat, as it is commonly referred to in the pulp manufacturing industry. It has been shown, however, that material such as sawdust, shavings, straw, bagasse, waste paper and semi-cooked chips do not possess sufficient internal friction or consistency to be arrested by the rifling and will still rotate along with the feed screw. Thus, the material is merely subjected to a churning action, with consequent minimized efficiency of the system or complete work stoppage.

SUMMARY OF THE INVENTION

The invention contemplates the elimination of the above problems by providing effective means for preventing the material from being rotated by the feed screw and insuring continuous uniform flow of the compressible non-fluid material through the casing or throat, regardless of its consistency or firmness.

The invention is characterized essentially by stopper means, such as a wheel, which is arranged to move in a closed circuit in a slot in the casing and in the direction of the linear flow of the material. During a portion of the cyclic movement of the stopper means, the latter engage the spiral groove of the feed screw and thus form a barrier for the material and prevent it from being carried along by the rotating screw. In a preferred embodiment, the stopper means comprise a sprocket wheel, or a toothed disc, which is rotatably mounted on a shaft extending transversely to the axis of the feed screw. The peripheral teeth or sprockets engage successively the spiral groove and preferably are shaped to conform to the contour thereof, so that they will mesh snugly therein in their position of full engagement.

The improved screw feeder according to the invention operates with significant decrease in plugging and clogging problems, with resultant higher feeding capacity. The aforementioned objects and advantages inherent in the invention will become more apparent from the following description of a preferred embodiment taken in conjunction with the accompanying drawings.

DESCRIPTION OF A PREFERRED EMBODIMENT

Figures 1, 2:
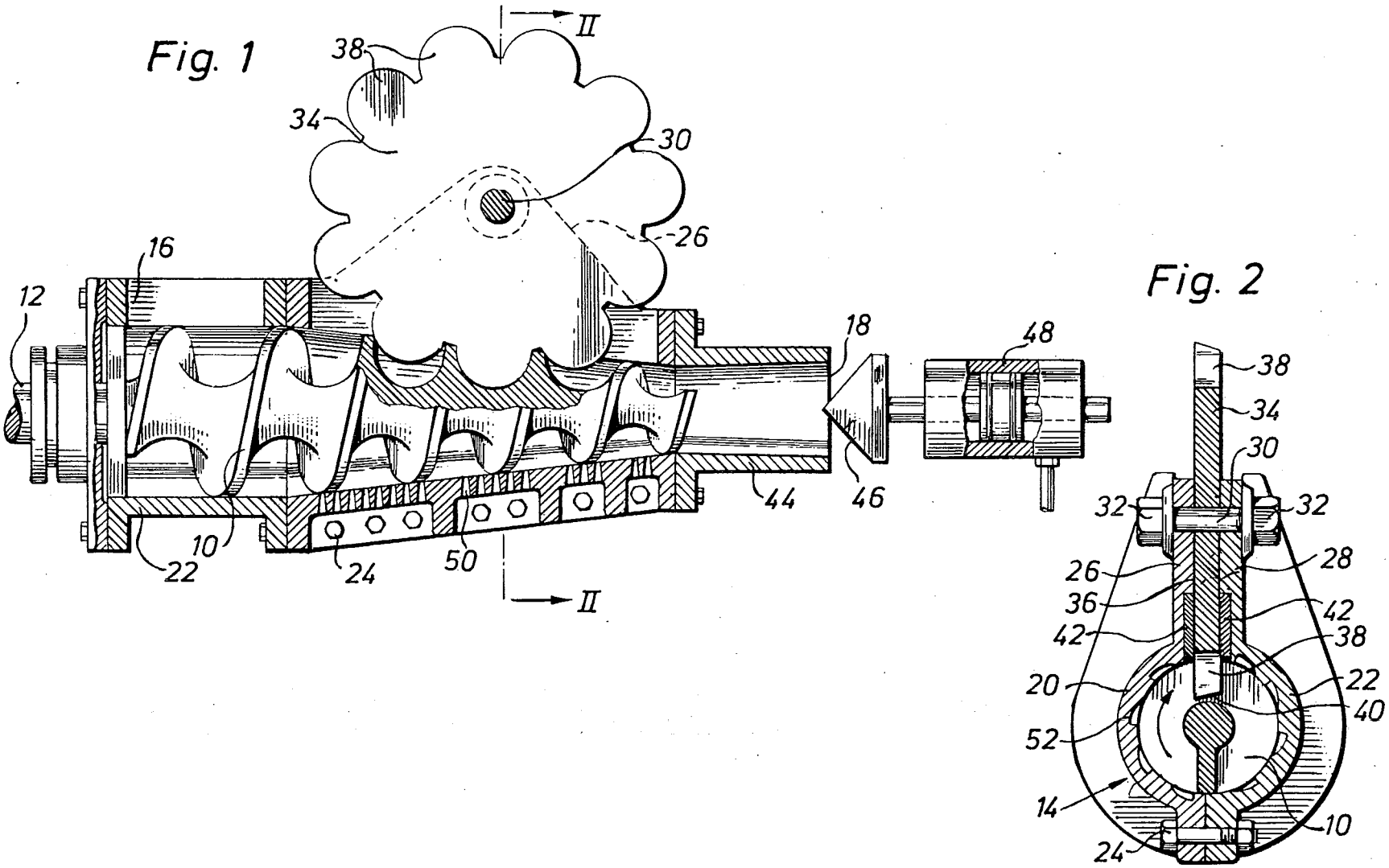
FIG. 1 is a side elevational view, partly in section, of a screw feeder according to an embodiment of the invention.
FIG. 2 is a cross-sectional view taken along the line II—II of FIG. 1.

Referring to the drawing, reference numeral 10 indicates the spiral flights of the screw feeder, which is rotated by shaft 12, which is driven by a motor (not shown). The feed screw with its spiral flights is surrounded by a casing generally indicated by reference numeral 14. The casing or throat 14 has a conical bore tapering from the inlet 16 toward the outlet end 18, which conforms to the conical profile of the screw flights. The raw material is received in this inlet 16 from a hopper, chute or the like, and is conveyed through the throat by the screw flights 10 towards the plug-forming conduit 44.

The casing 14 is split vertically into two equal components 20, 22, which are clamped together along their bottom by a series of bolts 24. Along their upper portion, each component is formed with a strong flange 26, 28, which jointly form a bearing for the transverse shaft 30. The two flanges are clamped together by the bolts 32 carried by each end of the shaft 30.

A relatively thin disc or sprocket wheel 34 is mounted on the shaft 30 and extends downwardly into the slot 36 between the flanges 26, 28. The disc is provided with peripheral teeth or sprockets 38, which, during the rotation of the feed screw, enter successively into the spiral groove between the screw flights.

The teeth or sprockets 38 are contoured so that they fit snugly in the groove when they are in full meshing engagement therein. The disc member 34 is thus analagous to a worm gear, and in the embodiment shown, is designed to be rotated by the feed screw. However, the disc member 34 may be driven separately by a motor, without departing from the invention. The teeth or sprockets 38 are cut on the bias at their periphery, as indicated at 40 in FIG. 2, so as to form a sharp edge.

The disc member 34 is preferably coated with stellite or some other wear-resistent material.

The flanges 26, 28 are provided at the bottom with shoes 42 of bronze or similar material, in order to enable them to absorb the axial pressure on the disc with a minimum of friction.

At the discharge end, the screw feeder is provided with a conventional plug-forming pipe 44, and a nozzle member 46 may be adjusted to regulate the degree of compression and the rate of discharge by means of a hydraulic servo motor 48. During the compression, water contained in the normally moist raw material is drained off through perforations 50 in the bottom portion of the casing 14.

During the operation of the screw feeder, the teeth or sprockets 38 function as stopper means which move synchronically into the transversely passing groove and thus arrest any rotary movement of the material. The downward movement of the teeth into the spiral groove is facilitated by the fact that the material at this point has not yet reached full degree of compression. It is assumed that the linear distance during which the tooth 38 is in engagement with the groove will be longer the greater the diameter of the disc. By allowing a tooth during its rotation to move into the spiral groove before the material has reached a substantially high degree of compression, the penetration of the tooth into the material will be restricted.

The rifling on the inner surface of the bore, as mentioned herein, is designated by the reference numeral 52 in FIG. 2. Since the advancing material is effectively prevented from rotation, this rifling may be eliminated by the use of the invention.

The periphery of the sprocket wheel may also be coated with stellite or other wear-resistant substance.

It should be understood that the foregoing description is given by way of example only, and the invention may find a variety of expressions within the scope of the accompanying claims.

I claim:

1. A screw conveyor for use in pulp making equipment for advancing a mass of pulp material from a material-supply station to a further-processing station, in an environment of pressurized steam while being gradually compressed into a steam-tight plug by the progressively increasing force of the advancing material, comprising:

(a) a horizontal casing having a conical bore tapering from a material inlet end to a material outlet end;

(b) said casing being split vertically into two equal components clamped together along their bottom portions, the top portions each having an upwardly flange defining a slot therebetween;

(c) a rotatable screw feeder extending through the conical bore of the casing, comprising helical flights and an intervening spiral groove and conforming to the inner diameter of said conical bore for advancing the material from the material inlet to the material outlet while being gradually compressed into a steam-tight plug;

(d) a sprocket wheel having teeth contoured to conform to the profile of said spiral groove for successively engaging the spiral groove synchronously with the screw feeder and mounted rotatably in said slot in frictional contact with said flanges for preventing the material from turning with the screw feeder during the advancement and compression thereof; and (e) means for maintaining said flanges in frictional contact with said sprocket wheel.

2. A screw conveyor according to claim 1, in which the sprocket wheel has a groove-engaging edge cut on the bias in the direction of rotation of the screw feeder.

3. A screw conveyor according to claim 1, having means adjacent the outlet end of the casing for regulating the degree of compression of the pulp material.

4. A screw conveyor according to claim 1, in which the diameter of the sprocket wheel is proportioned to produce a meshing engagement along a predetermined linear distance in the direction of the advancing material.

* * * * *